US007269967B2

(12) United States Patent
Cole

(10) Patent No.: US 7,269,967 B2
(45) Date of Patent: Sep. 18, 2007

(54) METHOD AND APPARATUS FOR REMOVING MOISTURE FROM EVAPORATOR COILS

(75) Inventor: James T. Cole, Algonquin, IL (US)

(73) Assignee: Gas Technology Institute, Des Plaines, IL (US)

( * ) Notice: Subject to any disclaimer, the term of this patent is extended or adjusted under 35 U.S.C. 154(b) by 208 days.

(21) Appl. No.: 11/208,920

(22) Filed: Aug. 22, 2005

(65) Prior Publication Data

US 2007/0039344 A1 Feb. 22, 2007

(51) Int. Cl.
*F25D 21/00* (2006.01)

(52) U.S. Cl. ..... 62/272; 62/285; 62/291

(58) Field of Classification Search ..... 62/272, 62/285, 291, 115, 279, 498, 515; 165/84
See application file for complete search history.

(56) References Cited

U.S. PATENT DOCUMENTS 3,011,500 A * 12/1961 Rand ..... 134/69
3,183,967 A * 5/1965 Dindial et al. ..... 165/83
3,789,617 A * 2/1974 Rannow ..... 62/115
4,899,697 A * 2/1990 Franklin et al. ..... 122/379
4,914,929 A * 4/1990 Shimazaki ..... 62/515
5,079,459 A * 1/1992 Huston et al. ..... 310/15
6,745,590 B1 * 6/2004 Johnson et al. ..... 62/272
2004/0249222 A1 * 12/2004 Zwieg ..... 568/689

FOREIGN PATENT DOCUMENTS

KR 2004083989 A * 10/2004

OTHER PUBLICATIONS

Harriman, III, Lewis G. et al., "Dehumidification Equipment Advances", ASHRAE Journal, Aug. 2002, pp. 22-27.
Shirey, III, Don B. et al., "Dehumidification at Part Load", ASHRAE Journal, Apr. 2004, pp. 42-47.

* cited by examiner

*Primary Examiner*—Mohammad M. Ali
(74) *Attorney, Agent, or Firm*—Mark E. Fejer

(57) ABSTRACT

A method and apparatus for removing excess moisture from the evaporator coils of an air-conditioning system in which the moisture is removed from the evaporator coils by vibrating the coils. The coils may be vibrated by mechanical or acoustic devices such as solenoid plungers and acoustic transducers.

8 Claims, 2 Drawing Sheets

METHOD AND APPARATUS FOR REMOVING MOISTURE FROM EVAPORATOR COILS

BACKGROUND OF THE INVENTION

1. Field of the Invention

This invention relates to a method and apparatus for removing excess moisture from moisture condensing surfaces. More particularly, this invention relates to a method and apparatus for removing excess moisture from the evaporator coils employed in air-conditioning systems.

2. Description of Related Art

Air-conditioning systems generally comprise five mechanical components: a compressor, a fan, a condenser coil, an evaporator coil, and a refrigerant. Air-conditioning systems transfer heat from the inside of a space to be conditioned to the outside. Refrigerant in the system absorbs the excess heat and is pumped through a closed system of piping to an outside coil. A fan blows outside air over the hot coil, transferring heat from the refrigerant to the outdoor air. Because the heat is removed from the indoor air, the space to be conditioned is cooled.

Two types of heat are removed by air-conditioning systems: temperature-associated sensible heat and moisture-associated latent heat. An evaporator coil typically operates by performing about 25% moisture removal and 75% cooling. If the sensible-heat ratio falls below 75%, then overcooling occurs in meeting the moisture-removal demand. This unnecessary cooling is usually rectified by adding heat to the space, consuming even more energy. Latent-heat ratios often become higher than 25% in hot and humid climates, where fresh air introduction brings in significant levels of moisture, upsetting the temperature and moisture balance of interior spaces and reducing comfort levels. Excessive moisture in the air may also contribute to indoor air quality problems.

Over the past several years, manufacturers have been working to increase the efficiency of residential and commercial air-conditioning systems. One method of increasing the air conditioner system efficiency has been to reduce the spacing of the fins on the evaporator coil. However, the result of this increase in the number of fins present is that moisture that is removed from the indoor air as it passes over the coil is retained on the coil instead of flowing down the drain.

Numerous articles have been published over the past several years discussing the issues related to retained moisture on high-efficiency air-conditioning coils. See, for example, Harriman III, L. G. et al., "Dehumidification Equipment Advances," *ASHRAE Journal*, August 2002, pp. 22-27; and Shirey III, D. B. et al., "Dehumidification at Part Load," *ASHRAE Journal*, April 2004, pp. 42-47. In addition, there is concern that the moisture in ductwork provides a breeding ground for bacteria. The situation is exacerbated by operation of the air-conditioning system in a continuous fan mode to allow air cleaning systems to perform. In such cases, as the air conditioner operates in a cycling fashion, the system loads retained moisture onto the evaporator coil, and then when the air conditioner cycles off, the fan evaporates the moisture and blows it into the conditioned space. This is an energy benefit from a sensible consideration as the evaporation lowers the air temperature, but if the space already has too much moisture, it can make the space uncomfortable. Additionally, the presence of excess moisture in both the ductwork and the conditioned space can have negative consequences.

SUMMARY OF THE INVENTION

It is, thus, one object of this invention to address issues associated with moisture retention by an air-conditioning system.

It is another object of this invention to provide a method and apparatus for increasing the efficiency of air-conditioning systems.

It is yet another object of this invention to provide a method and apparatus for removing moisture retained on the surfaces of the evaporator coils of an air-conditioning system.

These and other objects of this invention are addressed, in an air-conditioning system comprising at least one evaporator coil and a drain pan disposed beneath at least a portion of the at least one evaporator coil for capturing and draining moisture from the at least one evaporator coil, by vibratory means for vibrating the at least one evaporator coil whereby moisture disposed on the outer surface of the at least one evaporator coil is knocked off of the coil into the drain pan. To further promote the removal moisture, the evaporator coil in accordance with one embodiment of this invention comprises a hydrophobic material, either as a coating applied to at least a portion of the surface of the evaporator coil or dispersed within the evaporator coil material. Any commercially available hydrophobic material able to maintain its integrity and functionality in the environment of the evaporator coil may be employed. Deemed to be within the scope of this invention are both mechanical and acoustic means for vibrating the at least one evaporator coil.

BRIEF DESCRIPTION OF THE DRAWINGS

These and other objects of this invention will be better understood from the following detailed description taken in conjunction with the drawings, wherein.

DETAILED DESCRIPTION OF THE PRESENTLY PREFERRED EMBODIMENTS

As previously indicated, one object of this invention is to increase the efficiency of conventional higher efficiency air-conditioning systems. This is accomplished by an air-conditioning method and apparatus in which a significant portion of the moisture removed by the air-conditioning system from indoor air and retained on the outer surface of the evaporator coil of the system is knocked off the coil for collection in a drain pan disposed beneath at least a portion of the evaporator coil. By removing the moisture from the evaporator coil in this manner, the evaporation of moisture from the coil and reintroduction of the moisture into the conditioned space, which reintroduction reduces the efficiency of the system, is substantially precluded.

Figure 1:
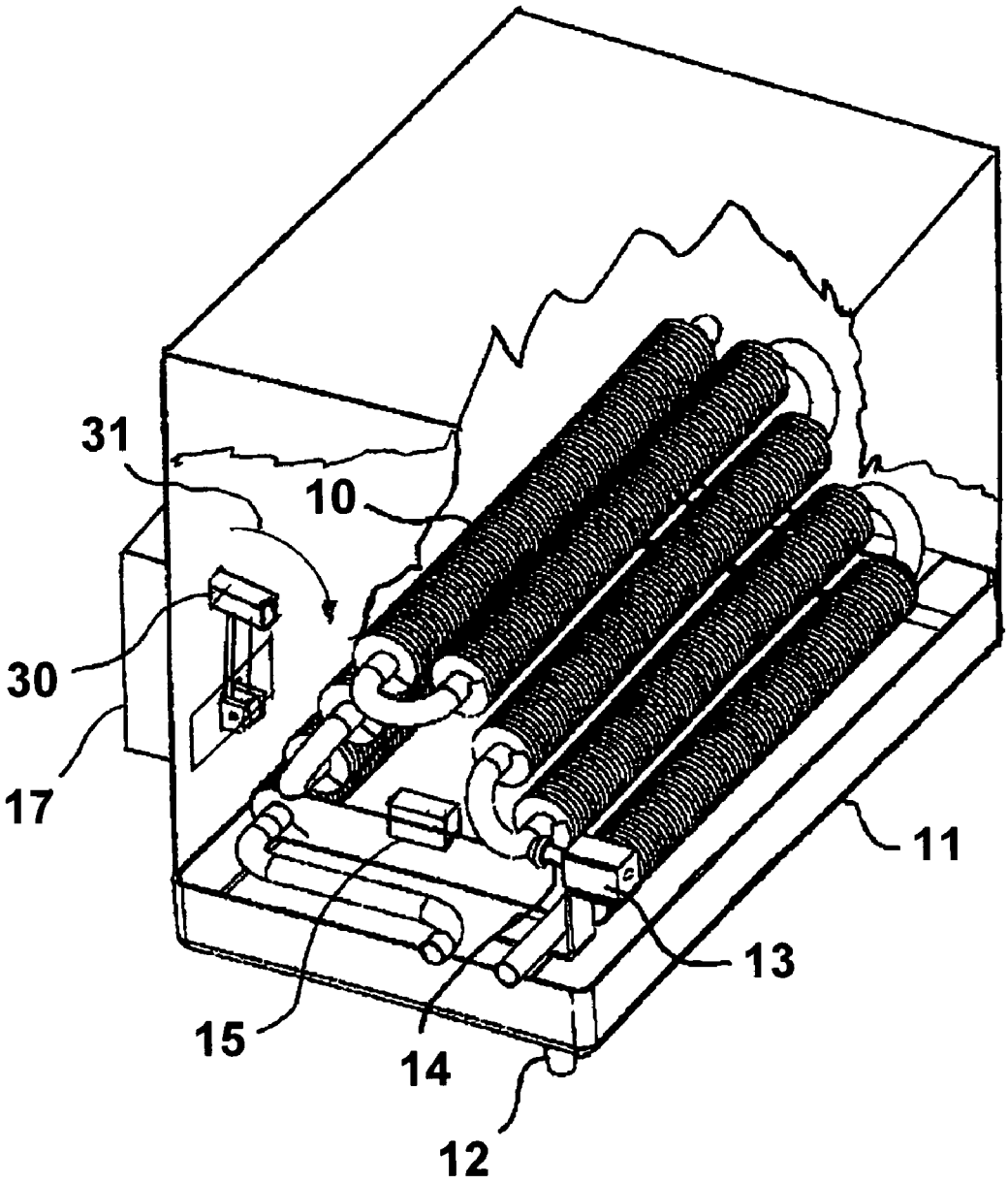
FIG. 1 is a perspective partial cutaway view of an air-conditioning system employing mechanical vibratory means for removing retained moisture from the evaporator coil in accordance with a plurality of embodiments of this invention.

An air-conditioning system employing a plurality of mechanical vibratory means for removing moisture from the outer surface of the evaporator coil in accordance with several possible embodiments of this invention is shown in FIG. 1. As shown therein, the apparatus in accordance with one embodiment of this invention comprises a solenoid plunger 13 attached to the evaporator coil 10. When the solenoid is energized, the plunger 14 rapidly deploys to smack into the body of the evaporator coil 10. The impact of the plunger 14 causes the water to fall down into the drain pan 11. This plunger action may be repeated several times as necessary. The plunger may be activated during the operation of the air-conditioning system or just subsequent to the air-conditioning system operation.

In accordance with a second embodiment of this invention also shown in FIG. 1, the vibratory means comprises a buzzer-type vibrator 15 attached to the evaporator coil 10. When the vibrator 15 is energized, it vibrates the evaporator coil 10 with sufficient energy to displace a portion of the retained moisture from the coil. The moisture that is removed in this fashion falls from the coil into the drain pan 11 and down the drain 12.

In accordance with yet another embodiment of this invention as shown in FIG. 1, the vibratory means comprises a hammer or clapper 30 movable in the direction of arrow 31 whereby, on striking of the evaporator coil 10 by the hammer or clapper 30, the retained moisture is knocked off of the evaporator coil into the drain pan.

Figure 2:
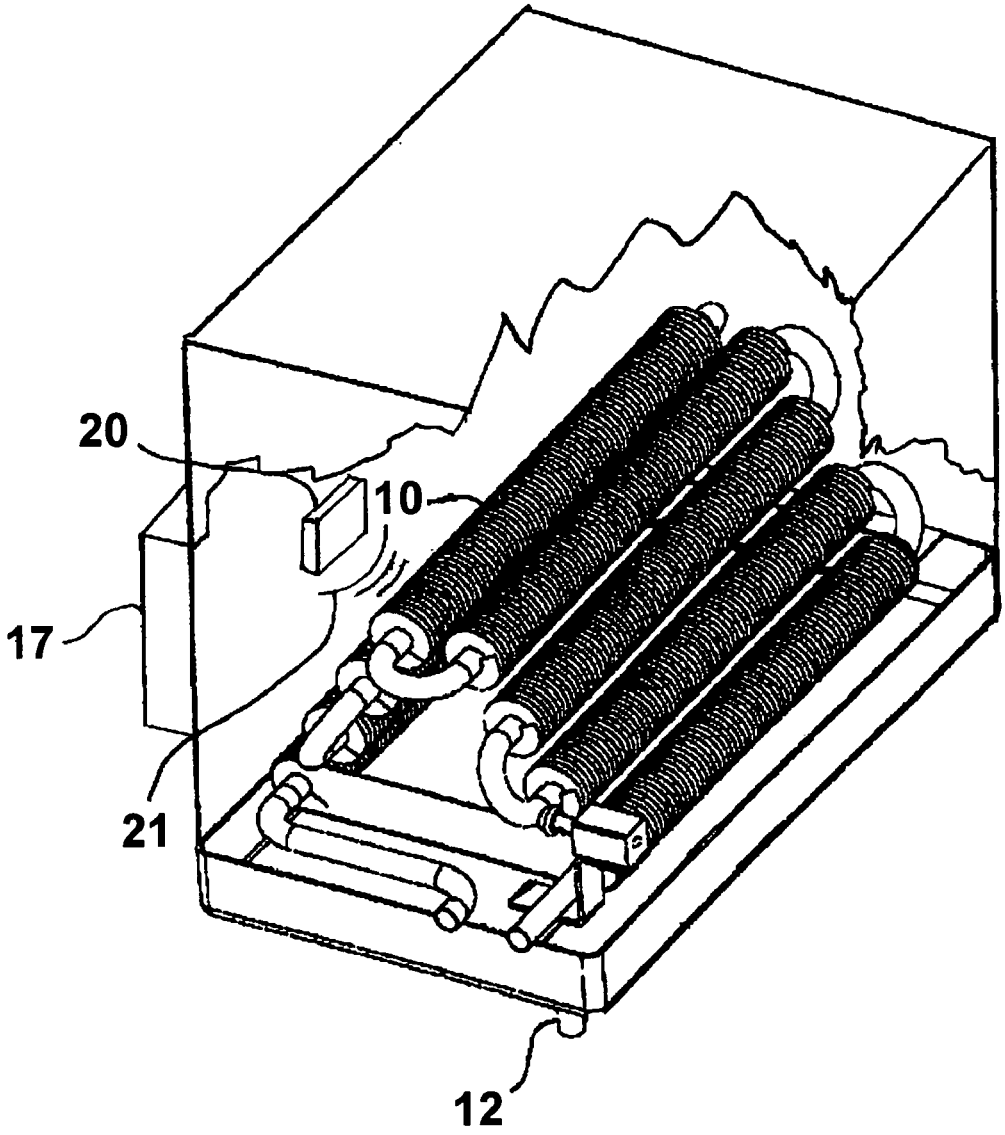
FIG. 2 is a perspective partial cutaway view of an air-conditioning system employing acoustic vibratory means in accordance with one embodiment of this invention.

In accordance with another embodiment of this invention as shown in FIG. 2, the vibratory means comprises an acoustic transducer 20 that emits a plurality of acoustic waves 21, which, upon contact with the evaporator coil 10, cause the evaporator coil to vibrate, thereby causing the retained moisture to fall from the evaporator coil into the drain pan. The acoustic frequency suitable for causing the evaporator coil to vibrate will vary depending upon the physical characteristics of the evaporator coil. However, routine experimentation with a variety of acoustic frequencies would allow one skilled in the art to determine a suitable acoustic frequency for a given evaporator coil design.

It will be apparent to those skilled in the art that there are numerous control means 17 by which the operation of the vibratory means can be controlled. For example, if a humidity sensor is employed in the operation of the air-conditioning system, it can be interlocked to the vibratory means to turn these devices on or off as needed.

The method for removing moisture from the outer surface of an evaporator coil in accordance with one embodiment of this invention comprises the step of vibrating the at least one evaporator coil by suitable vibratory means, resulting in removal of at least a portion of the moisture from the at least one evaporator coil. Vibration of the at least one evaporator coil is accomplished in accordance with one embodiment of this invention by striking the at least one evaporator coil with any impact element, such as a hammer or clapper or solenoid plunger. In accordance with another embodiment of this invention, vibration of the at least one evaporator coil is accomplished using a vibrating element attached to the at least one evaporator coil. In accordance with yet another embodiment of this invention, vibration of the at least one evaporator coil is accomplished using an acoustic transmitter that emits sonic waves in the direction of the at least one acoustic evaporator coil. In all cases, vibrating of the evaporator coil is activated by a control means which monitors the amount of moisture disposed on the at least one evaporator coil.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In an air-conditioning system comprising at least one evaporator coil and a drain pan disposed beneath at least a portion of said at least one evaporator coil, said drain pan having at least one drain opening, the improvement comprising:

vibratory means for vibrating said at least one evaporator coil, whereby moisture disposed on an outer surface of said at least one evaporator coil is removed, said vibratory means comprising at least one solenoid plunger having at least one plunger element in non-continuous contact with said at least one evaporator coil.

2. An air-conditioning system in accordance with claim 1, wherein said vibratory means comprises at least one acoustic transducer acoustically coupled with said at least one evaporator coil.

3. An air-conditioning system in accordance with claim 1, wherein said at least one evaporator coil is at least partially coated with a hydrophobic agent.

4. In an air-conditioning system having at least one evaporator coil, a method for removing moisture on an outer surface of said evaporator coil comprising the steps of:

vibrating said at least one evaporator coil resulting in removal of at least a portion of said moisture from said at least one evaporator coil, said vibrating activated by a control means monitoring an amount of said moisture disposed on said at least one evaporator coil.

5. A method in accordance with claim 4, wherein said at least one evaporator coil is vibrated by striking said at least one evaporator coil with an impact element.

6. A method in accordance with claim 4, wherein said at least one evaporator coil is vibrated by a vibrating element attached to said at least one evaporator coil.

7. A method in accordance with claim 4, wherein said at least one evaporator coil is vibrated by an acoustic transmitter emitting sonic waves in a direction of said at least one evaporator coil.

8. A method in accordance with claim 5, wherein said impact element is a solenoid plunger attached to said at least one evaporator coil.

* * * * *